US006530789B2

(12) United States Patent
Konda

(10) Patent No.: US 6,530,789 B2
(45) Date of Patent: Mar. 11, 2003

(54) STRUCTURE FOR CONNECTING TERMINAL OF SHIELDED CABLE

(75) Inventor: Kazumoto Konda, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/862,508

(22) Filed: May 23, 2001

(65) Prior Publication Data

US 2001/0053633 A1 Dec. 20, 2001

(30) Foreign Application Priority Data

Jun. 20, 2000 (JP) ..... 2000-184701

(51) Int. Cl.[7] ..... H01R 13/648
(52) U.S. Cl. ..... 439/98; 439/610
(58) Field of Search ..... 439/98, 585, 610, 439/874

(56) References Cited

U.S. PATENT DOCUMENTS 4,116,521 A * 9/1978 Herrmann, Jr. ..... 339/60
4,131,332 A * 12/1978 Hogendobler et al. ..... 339/177
4,614,398 A * 9/1986 Wright et al. ..... 339/143
4,898,173 A * 2/1990 Daglow et al. ..... 128/419
4,902,249 A * 2/1990 Morishita et al. ..... 439/610
4,963,104 A * 10/1990 Dickie ..... 439/460
5,460,544 A * 10/1995 Inaba et al. ..... 439/578
5,498,176 A 3/1996 Hashizawa et al.
5,860,833 A * 1/1999 Chillscyzn et al. ..... 439/585
6,025,560 A * 2/2000 De Buyst et al. ..... 174/88
6,210,223 B1 * 4/2001 Aoyama et al. ..... 439/585
6,257,931 B1 * 7/2001 Sakurai et al. ..... 439/610
6,261,108 B1 * 7/2001 Kanagawa et al. ..... 439/98

* cited by examiner

*Primary Examiner*—Tho D. Ta
*Assistant Examiner*—Edwin A. León
(74) *Attorney, Agent, or Firm*—Oliff & Berridge, PLC

(57) ABSTRACT

A connecting tube has a middle portion in the direction of length thereof, which is preliminarily narrowed, and is fixed by being press-fitted into a mounting hole of a shield wall. At a terminal of a shielded cable, an exposed end portion of the shield layer is turned up and put upon a C-ring for underlaying fitted into an end portion of an outer sheath. The shielded cable, on which such terminal processing is performed, is inserted into the connecting tube. A narrowed portion of the connecting tube is caulked so that the shield layer is sandwiched between the narrowed portion of the connecting tube and the C-ring. At that time, at both the front and rear end portions of the caulked portion of the connecting tube, tapering portions, or bellmouths are formed so that their radial dimensions gradually increase in opposite directions, respectively.

7 Claims, 6 Drawing Sheets

STRUCTURE FOR CONNECTING TERMINAL OF SHIELDED CABLE

BACKGROUND OF THE INVENTION

1. Field of the Invention

The present invention relates to a structure for connecting a shield layer of a terminal of a shielded cable to a shield wall.

2. Description of the Related Art

Hitherto, there has been known such a kind of a terminal connecting structure illustrated in FIG. 6. In this structure, a stepped connecting tube 3 having a front-end side portion reduced in diameter is press-fitted into and fixed in a mounting hole 2 opening in a longitudinally extending shield wall 1. An end portion of a shield layer 5, constituted by a braided wire, is exposed at a terminal of a shielded cable 4. Then, the exposed portion is turned up and put upon a corresponding end portion of the outer sheath 7 through an underlay C-ring 6. The turned-up portion 5A of the shield layer 5 is inserted into a diameter reduction portion 3A of the connecting tube 3 and fastened thereto by caulking the diameter reduction portion 3A so that the shield layer 5 is sandwiched between the portion 3A and the C-ring 6.

However, the diameter reduction portion 3A of the connecting tube 3 is caulked along its entire length in the related art, a portion 8 between the diameter reduction portion 3A and a diameter enlargement portion 3B of the connecting tube 3 is formed like a bellmouth, whose diameter gradually increases from portion 3A to portion 3B at a place corresponding to a side of the turned-up end portion of the shield layer 5 (at the right end side, as viewed in FIG. 6), and the portion 8 is merely engaged to the shielded cable 4. Thus, when the shielded cable 4 is pushed forward (that is, to the left, as viewed in this figure), the above engaging portion 8 becomes an engaging point so that engaging forth can be obtained. Whereas, when the shielded cable 4 is pulled backwardly, the engaging force is weak so that the shielded cable 4 easily comes off from the connecting tube 3.

Further, in the related art, the front end of the connecting tube 3 is set at the same position as a position of a folded-back portion 5A of the shield layer 5, or at a position behind the folded-back portion 5A. Consequently, the folded-back portion 5A of the shield layer 5 is exposed. Thus, there are fears that the portion 5A may touch other components and may be damaged, and that when the connecting tube 3 is caulked, the shield layer 5 may be cut by the front edge of the tube 3.

The invention is accomplished in view of the aforementioned circumstances. Accordingly, an object of the invention is to increase a fastening force to connect the shield layer to the shield wall. Further, another object of the invention is to protect the exposed portion of the shield layer.

SUMMARY OF THE INVENTION

To achieve the foregoing objects, according to a first aspect of the invention, there is provided a structure for connecting a terminal of a shielded cable comprising:

a shielded cable having a shield layer exposed at the end of the shielded cable; and a connecting tube attached to an opening formed in a shield wall, wherein the connecting tube has a large diameter portion at each end and a small diameter portion; and the small diameter portion is caulked to be press-fitted to the shielded cable.

According to a second aspect of the invention, there is provided the structure according to the first aspect of the invention, wherein the connecting tube has two intermediate portions, whose diameters taper from a large diameter to a small diameter.

According to a third aspect of the invention, there is provided the structure according to the first or second aspect of the invention, wherein the end of the connecting tube covers the exposed shield layer.

According to a fourth aspect of the invention, there is provided the structure according to any one of the first to third aspects of the invention, wherein one of the large diameter portions is larger in diameter than the other thereof.

According to a fifth aspect of the invention, there is provided the structure according to any one of the first to fourth aspects of the invention, wherein one of the large diameter portions has a guiding tapered portion, which is bent inwardly, at the end of the large diameter portion.

According to a sixth aspect of the invention, there is provided a structure for connecting a terminal of a shielded cable comprising:

a shielded cable having a shield layer exposed at the end of the shielded cable; and a connecting tube attached to an opening formed in a shield wall, wherein the end of the connecting tube covers the exposed shielded cable; and the connecting tube is caulked to be press-fitted to the shielded cable.

According to a seventh aspect of the invention, there is provided the structure according to the sixth aspect of the invention, wherein the end of the connecting tube is bent inwardly to cover with the exposed shielded cable.

According to the first aspect of the invention, the connecting tube is caulked in such a manner as to form the two bellmouths so that the radial dimensions of the bellmouths gradually increase in opposite directions, respectively. Thus, in the case of moving the shielded cable in both the forward and backward directions, the bellmouths serve as an engaging point for holding the shielded cable and thus can restrict the movement of the shielded cable. Consequently, the fastening force can be increased.

According to the fourth aspect of the invention, the diameter at the front end side of the connecting tube is made to be small. This facilitates an operation of inserting the connecting tube into the shielded wall.

According to the fifth aspect of the invention, the guiding tapered part leads the connecting tube into the mounting hole. Consequently, the operation of inserting the connecting tube into the mounting hole is facilitated.

According to the third or sixth aspect of the invention, the front end portion of the connecting tube covers and protects the front end of the shield layer and the vicinity thereof, thereby preventing the front end of the shield layer from touching other components. Moreover, the shield layer is prevented from being cut by the edge of the front end portion of the connecting tube when the connecting tube is caulked.

According to the seventh aspect of the invention, the front surface of the front end portion of the shield layer is covered, so that the front end portion thereof is more reliably protected.

DETAILED DESCRIPTION OF THE PREFERRED EMBODIMENTS

Figure 1:
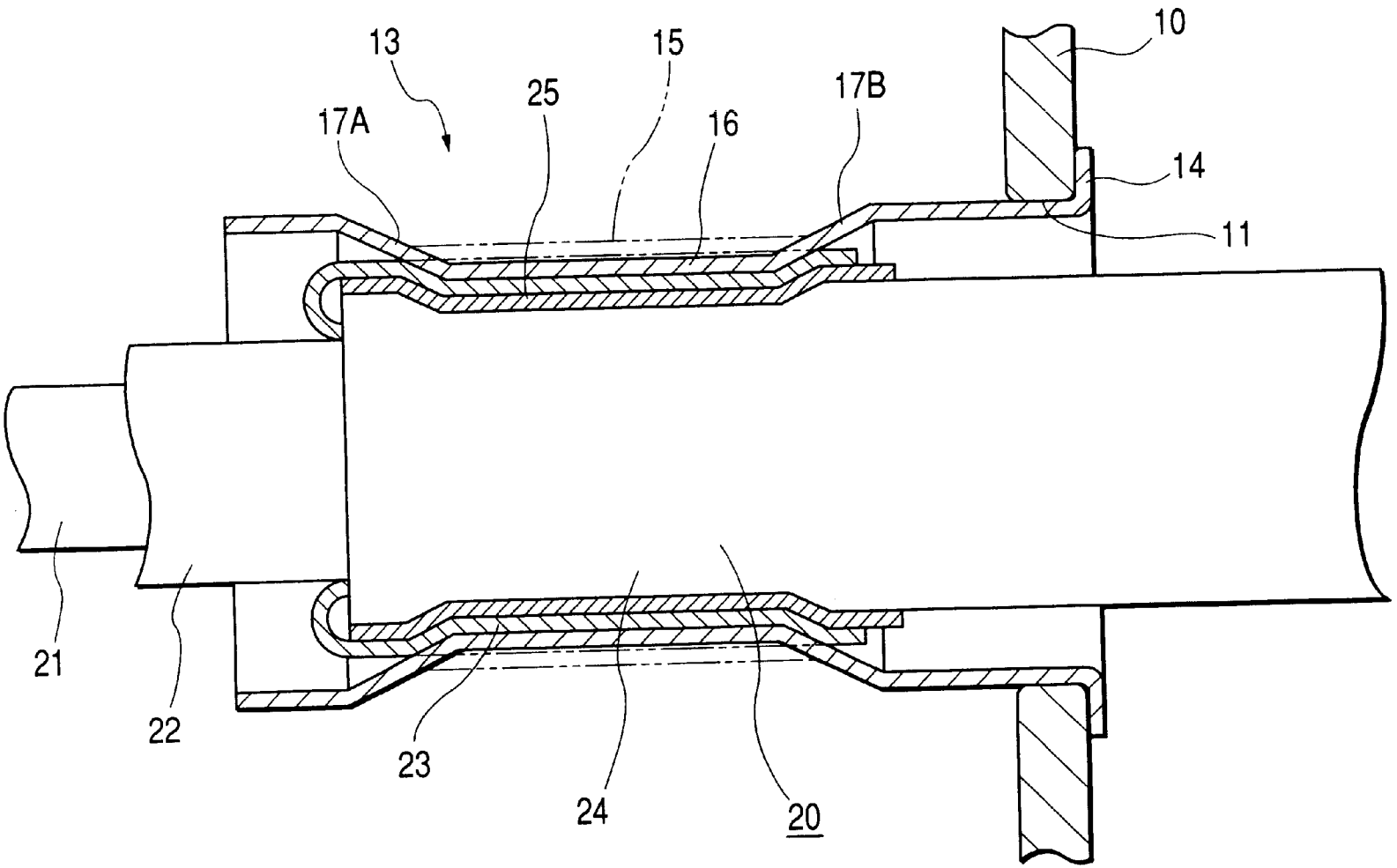
FIG. 1 is a sectional view of a first embodiment of the invention.

Hereinafter, various embodiments of the invention are described with reference to the accompanying drawings.

(First Embodiment)

A first embodiment corresponding to a first aspect of the invention is described with reference to FIG. 1. Reference numeral 10 designates a shield wall formed of a metallic case of equipment and the like. A circular mounting hole 11 is opened at a predetermined place in the shield wall 10.

A connecting tube 13 to be caulked is attached into the mounting hole 11. The connecting tube 13 is made of metal, and formed in a cylinder enabling it to be press-fitted into the mounting hole 11. More particularly, a flange 14 is formed along a rear edge of the connecting tube 13. Moreover, as indicated by chain lines in FIG. 1, a middle portion having predetermined length at a position which is a little close to the front end side in the direction of length of the tube 13 is preliminarily narrowed.

The shielded cable 20 has a structure in which a core wire 21, an inner insulating layer 22, a shield layer 23 formed of a braided wire, and an outer sheath 24 are serially provided from a core side in this order. At a terminal of the cable 20, the core wire 21, the inner insulating layer 22, and the shield layer 23 are exposed serially in this order. A terminal metal fitting (not shown) is connected to the terminal of the cable conductor 21.

An underlay C-ring 25 is fitted onto the terminal of the outer sheath 24, while the terminal of the shield layer 23 is turned up and put on the C-ring 25. Incidentally, the dimension of the turned-up portion of the shield layer 23 is slightly larger than the length of the narrowed portion 15 of the connecting tube 13.

Assembly of this structure is performed as follows. First, the connecting tube 13 is inserted into the mounting hole 11 of the shield wall 10 from a surface side (that is, the right side, as viewed in FIG. 1). When the flange 14 touches an opening edge on a surface of the mounting hole 11, the connecting tube 13 is press-fitted into the mounting hole 11 in a state where the connecting tube 13 projects to the rear surface side of the shield wall 10 laterally.

Subsequently, the shielded cable 20, which undergoes terminal processing by turning up the shield layer 23 partly on the C-ring 25, is inserted into the connecting tube 13 from the surface side.

As the turned-up shield layer 23 of the shielded cable 20 just enters the inside of the narrowed portion 15 of the connecting tube 13, the insertion of the shielded cable 20 stops. Subsequently, a position of the connecting tube 13 corresponding to the narrowed portion 15 is caulked by using an appropriate jig while sandwiching the shield layer 23 between the C-ring 25 and a caulked portion.

At that time, the connecting tube 13 is caulked in such a manner as to form tapering sections 17A and 17B,also known as bellmouths, which gradually increase in radial dimension, and are formed to be in opposite directions with respect to each other.

Consequently, a part of a base end portion of the front-side bellmouth 17A, engages the shield layer 23, and serves as an engaging point when the cable 20 is rearwardly pulled (that is, pulled to the right side, as viewed in FIG. 1). Further, a part of a base end portion of the rear-side bellmouth 17B, engages the shield layer 23, and serves as an engaging point when the cable 20 is forwardly pushed. That is, the movement of the shielded cable 20 in both the directions of push and pull of the cable 20 is effectively prevented. In other words, the shielded cable 20 is firmly fastened to the connecting tube 13.

(Second Embodiment)

Figure 2:
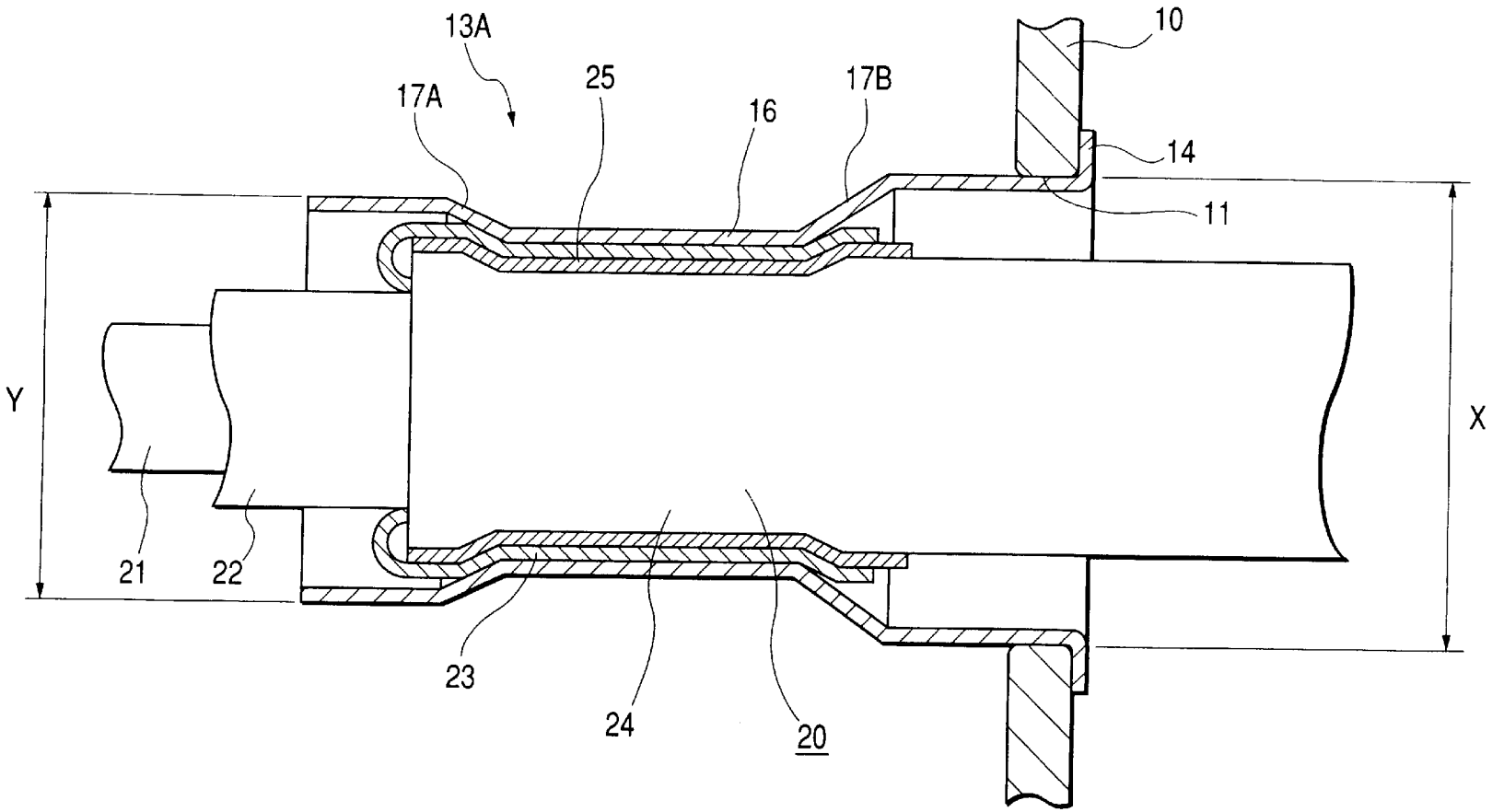
FIG. 2 is a sectional view of a second embodiment of the invention.

FIG. 2 shows a second embodiment corresponding to a second aspect of the invention. In a connecting tube 13A of the second embodiment having a rear-end side portion and a front-end side portion that sandwich the caulked portion 16 therebetween, the rear-end side portion is formed in such a way as to have a diameter X for enabling the rear-end side portion to be press-fitted into the mounting hole 11. Whereas, a diameter Y of the front-end side portion is set at a value that is smaller than the diameter X of the rear-end side portion.

The rest of the structure is similar to the corresponding parts of the first embodiment. In FIG. 2, like reference numerals designate like parts of the first embodiment, which have the same function. Thus, the repetition of the description of such parts is omitted.

In the second embodiment, the two bellmouths 17A and 17B are formed to be in opposite directions with respect to each other by caulking the connecting tube 13A so that the fastening force is increased. In addition, the connecting tube 13A is formed so that the diameter Y of the front-end side portion is smaller than the diameter X of the rear-end side portion, thereby facilitating the operation of inserting the connecting tube 13A into the mounting hole 11.

(Third Embodiment)

Figure 3:
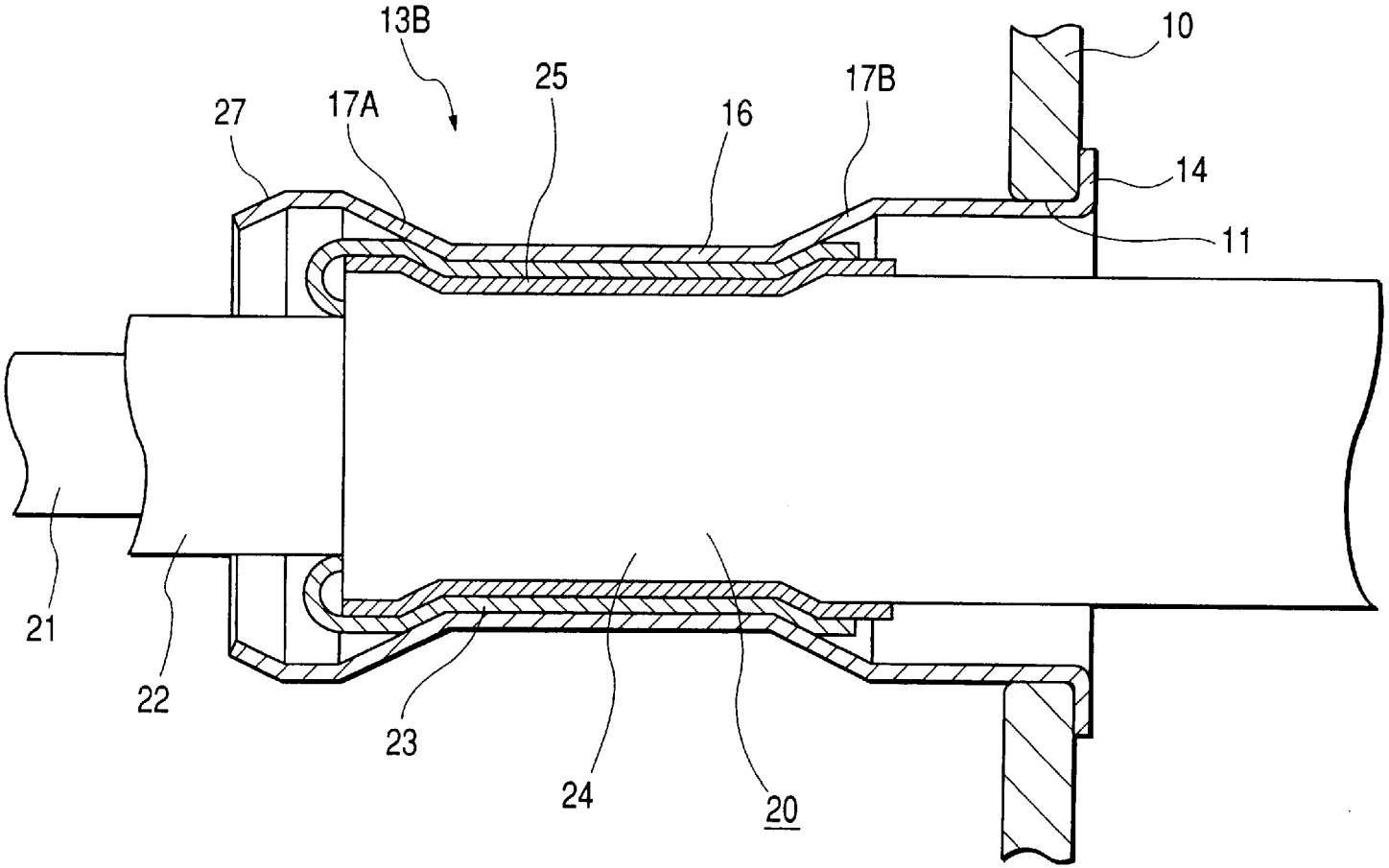
FIG. 3 is a sectional view of a third embodiment of the invention.

FIG. 3 shows a third embodiment corresponding to a third aspect of the invention. In the third embodiment, comparing with the first embodiment, the front end portion of the connecting tube 13B is obliquely and inwardly bent, and the guiding tapered portion 27, whose radial dimension gradually decreases to the front end thereof, is formed at the front end thereof. The remaining structure of the third embodiment is the same as the structure of the first embodiment.

In the third embodiment, even when misalignment of core occurs during insertion of the connecting tube 13B into the mounting hole 11, alignment therebetween is automatically performed by touching the opening edge of the mounting hole 11 with the guiding tapered portion 27. Thus, the connecting tube 13B is inserted into the mounting hole 11. Consequently, the operation of inserting the connecting tube 13B into the mounting hole 11 is smoothly and easily performed.

Incidentally, a guiding tapered portion may be provided at the front end portion of the connecting tube 13A, whose radial dimension is reduced, as exemplified in the description of the second embodiment.

(Fourth Embodiment)

Figure 4:
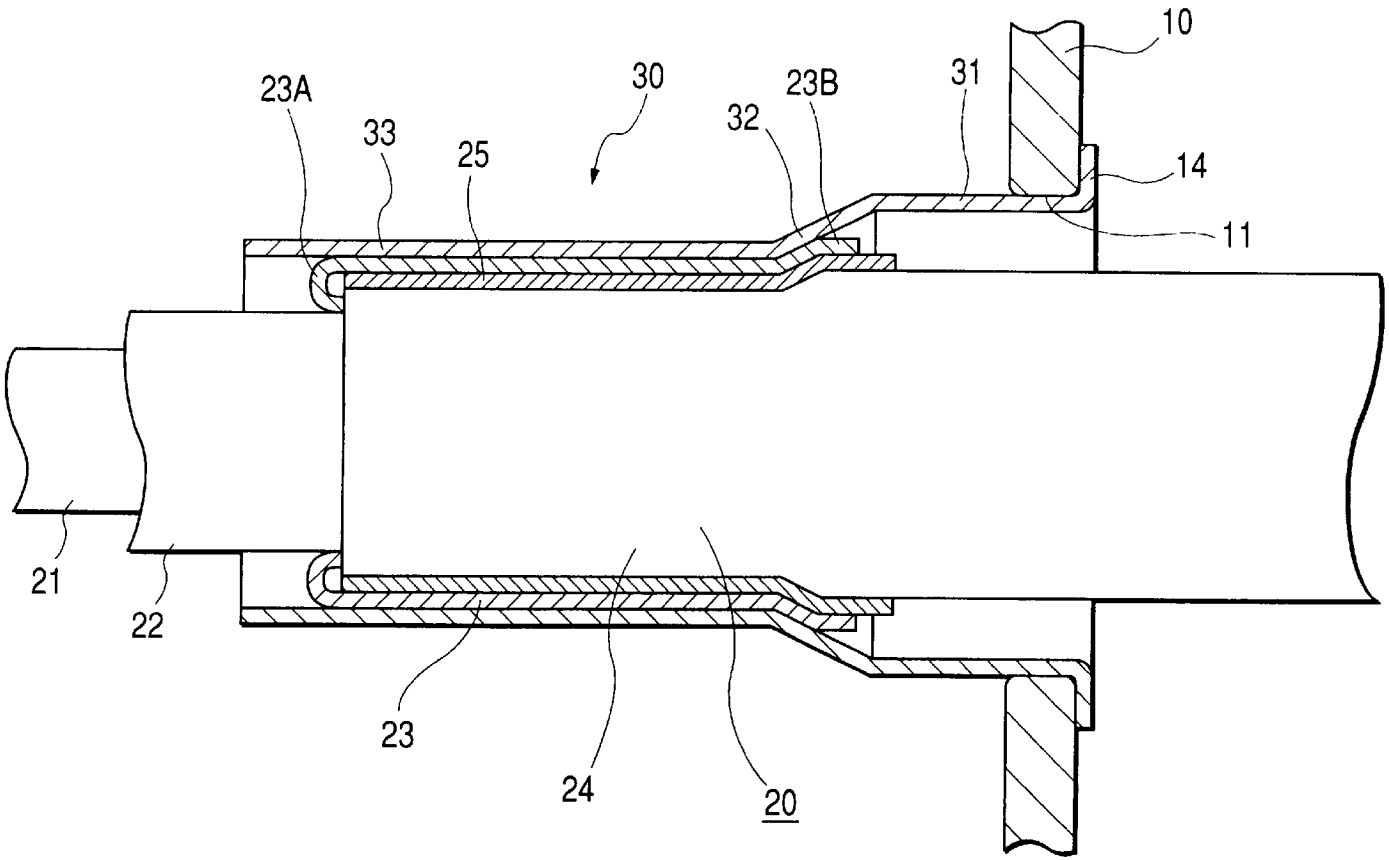
FIG. 4 is a sectional view of a fourth embodiment of the invention.

Next, a fourth embodiment corresponding to a fourth aspect of the invention is described hereinbelow with reference to FIG. 4.

A connecting tube 30 according to the fourth embodiment is shaped so that a diameter reduction portion 33 is continuously provided in front of a press-fitted portion 31, which has a flange 14 that can be press-fitted into a mounting hole 11 bored in the shield wall 10, through the tapered portion 32 tapering off to the front. Meanwhile, the structure of a shielded cable 20 is similar to that of the cable 20 according to the first embodiment. Particularly, the diameter reduction portion 33 of the connecting tube 30 is larger in a length in the direction of the axis thereof than the turned-up shield layer 23 of the shielded cable 20.

When the turned-up shield layer 23 of the shield cable 20 is inserted into the connecting tube 30 during the assembly of the structure, a folded-back portion 23A of the shield layer 23 is placed more backward than the front edge of the diameter reduction portion 33. Further, the turned-up end portion 23B of the shield layer 23 extends beyond the rear end of the diameter reduction portion 33. At that time, insertion of the layer 23 stops. In such a state, the diameter reduction portion 33 of the connecting tube 30 is caulked along its entire length and fixed to the cable 20 while the shield layer 23 is sandwiched between the C-ring 25 and the diameter reduction portion 33.

In this embodiment, the front end of the diameter reduction portion 33 of the connecting tube 30 is set to project beyond the folded-back portion 23A of the shield layer 23, thereby preventing the front edge of the diameter reduction portion 33 from cutting the shield layer 23 when the portion 33 is caulked. Moreover, after being caulked, the front end part of the diameter reduction portion 33 covers the periphery of the folded-back portion 23A of the shield layer 23, thereby protecting the folded-back portion 23A from hitting other components.

(Fifth Embodiment)

Figure 5:
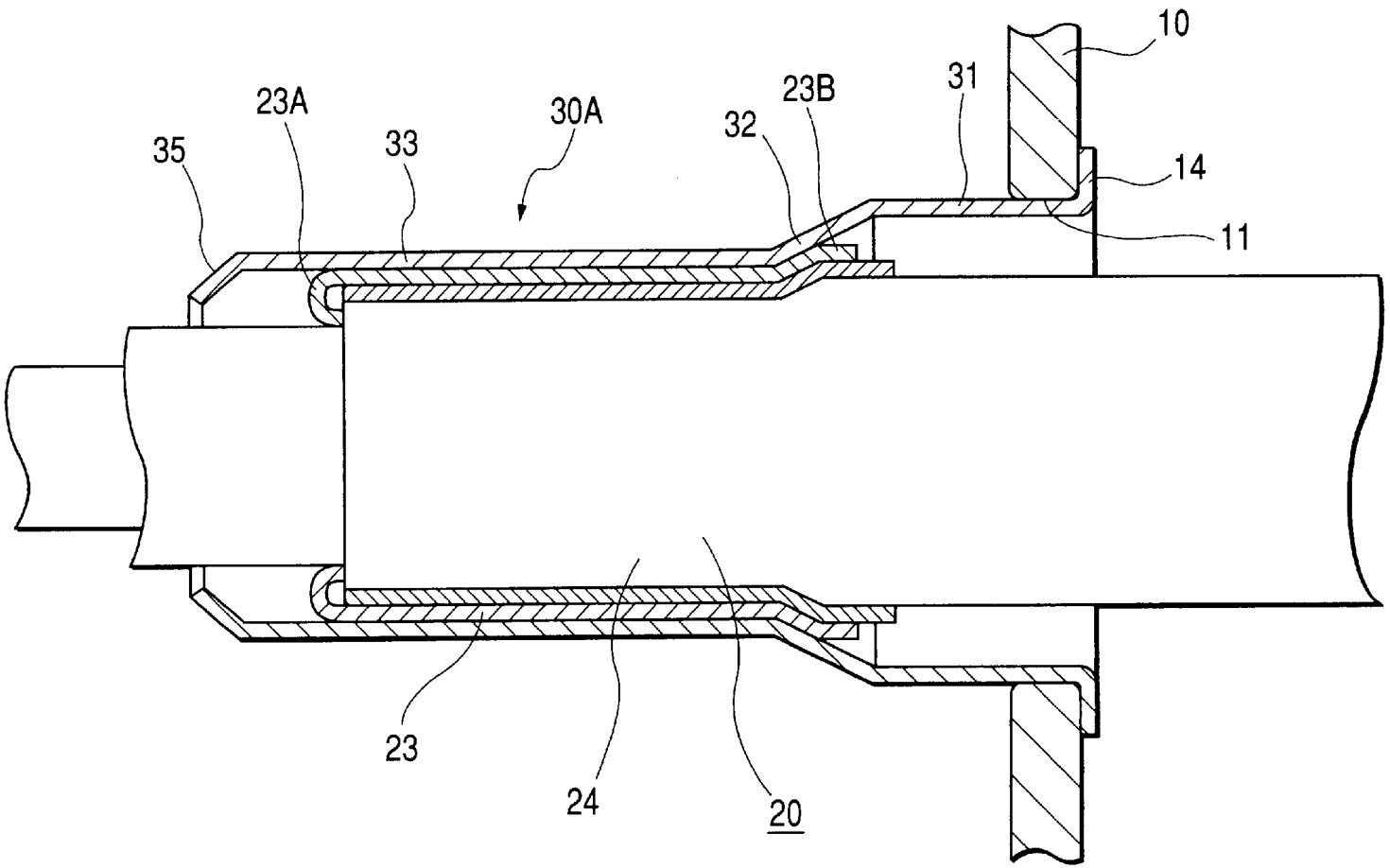
FIG. 5 is a sectional view of a fifth embodiment of the invention.
Figure 6:
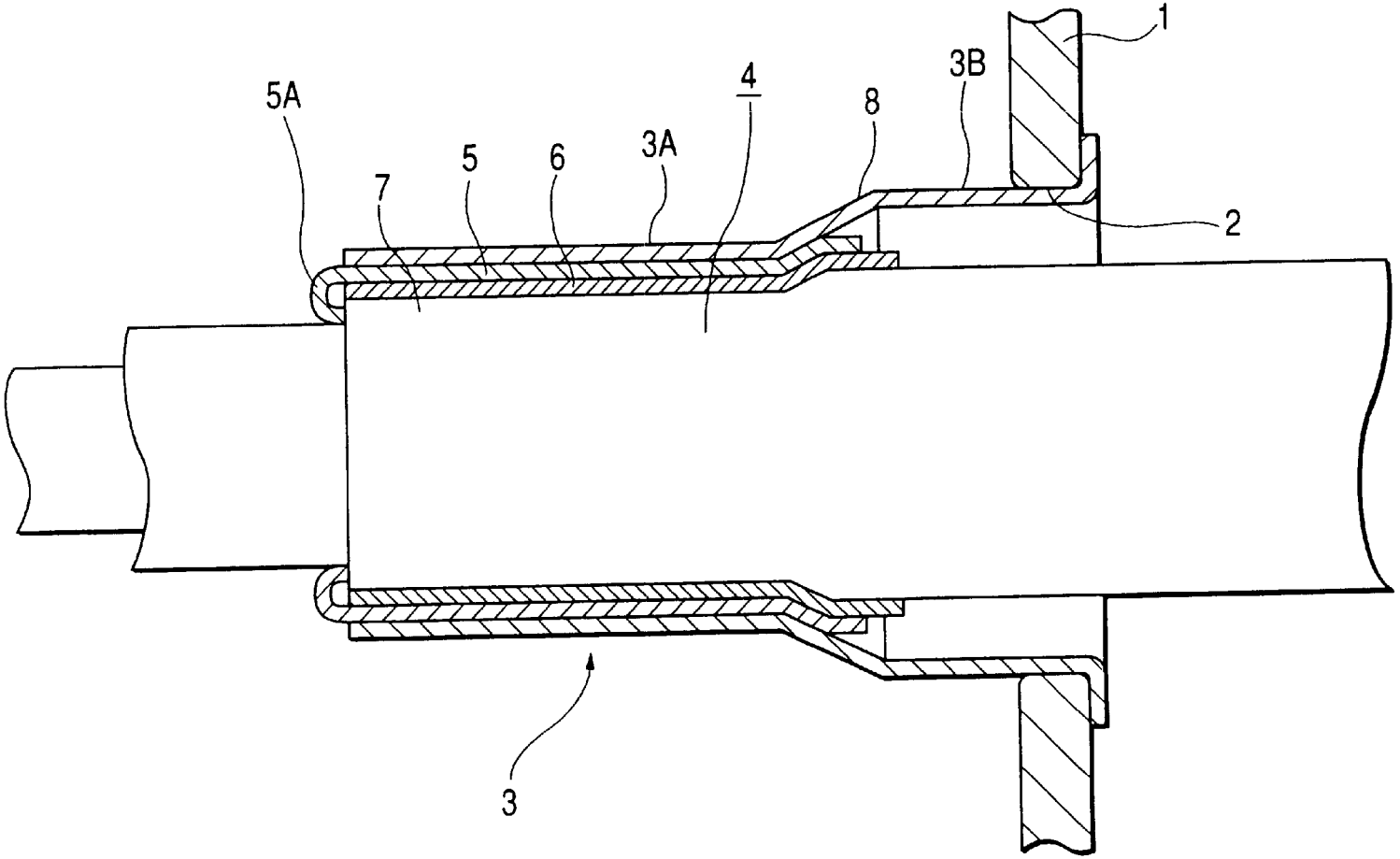
FIG. 6 RELATED ART
FIG. 6 is a sectional view of a related art.

FIG. 5 shows a fifth embodiment corresponding to a fifth aspect of the invention. The fifth embodiment is a modification of the fourth embodiment. The front end part of a diameter reduction portion 33 of a connecting tube 30A is obliquely and inwardly bent. Moreover, a protective tapered portion 35, whose radial dimension gradually decreases to the front thereof, is formed. The rest of this structure is similar to the corresponding part of the structure according to the fourth embodiment.

In the fifth embodiment, the front part of the folded-back portion 23A is more reliably covered with the protective tapered portion 35.

Incidentally, the protective tapered portion 35 can be utilized as a guide for inserting the connecting tube 30A into the mounting hole 11 formed in the shield wall 10.

(Other Embodiments)

The invention is not limited to the embodiments described in the foregoing description and the accompanying drawings. Various modifications can be made therein without departing from the gist thereof.

What is claimed is:

1. A structure for connecting a terminal, comprising:

a shielded cable having a shield layer exposed at an end of the shielded cable;

a shield wall defining an opening;

a connecting tube attached to the opening defined in the shield wall, an end of the connecting tube covering an end of the exposed shield layer, the connecting tube having two large diameter portions at both ends and a small diameter portion, the small diameter portion being caulked to be press-fitted to the shielded cable; and a c-ring attached to the shielded cable having two large diameter portions, one at each end, and a small diameter portion, wherein the c-ring is provided on the shielded cable with the shield layer wrapping thereover so as to wedge the shield layer between the c-ring and the small diameter portion of the connecting tube.

2. The structure according to claim 1, wherein the connecting tube has two intermediate tapering portions, whose diameters taper from the large diameter to the small diameter.

3. The structure according to claim 1, wherein the end of the connecting tube covers the exposed shield layer.

4. The structure according to claim 1, wherein one of the large diameter portions is larger in diameter than the other thereof.

5. The structure according to claim 1, wherein one of the large diameter portions has a guiding tapered portion, which is bent inwardly, at an end of the large diameter portion.

6. A structure for connecting a terminal, comprising:

a shielded cable having a shield layer exposed at an end of the shielded cable;

a shield wall defining an opening;

a connecting tube attached to the e opening defined in the shield wall, an end of the connecting tube covering the exposed shielded cable; and a c-ring attached to the shielded cable, wherein the c-ring is provided on the shielded cable with the shield layer wrapping thereover, so as to wedge the shield layer between the c-ring and the connecting tube, wherein the connecting tube is caulked to be press-fitted to the shielded cable;

the connecting tube has a large diameter portion and a small diameter portion; and the end of the connecting tube has the same diameter as the small diameter portion.

7. The structure according to claim 6, wherein the end of the connecting tube is bent inwardly to cover the exposed shielded cable.

* * * * *